US008192219B2

(12) United States Patent
Satoh

(10) Patent No.: US 8,192,219 B2
(45) Date of Patent: Jun. 5, 2012

(54) CONNECTOR FOR PLATE-SHAPED OBJECT

(75) Inventor: Tomoyuki Satoh, Kanagawa (JP)

(73) Assignee: Kyocera Connector Products Corporation (JP)

( * ) Notice: Subject to any disclaimer, the term of this patent is extended or adjusted under 35 U.S.C. 154(b) by 171 days.

(21) Appl. No.: 12/755,734

(22) Filed: Apr. 7, 2010

(65) Prior Publication Data

US 2010/0261369 A1 Oct. 14, 2010

(30) Foreign Application Priority Data

Apr. 9, 2009 (JP) ..... 2009-095293

(51) Int. Cl.
*H01R 13/62* (2006.01)

(52) U.S. Cl. ..... 439/328

(58) Field of Classification Search ..... 439/325, 439/327, 328, 495, 260
See application file for complete search history.

(56) References Cited

U.S. PATENT DOCUMENTS

| | | | | |
|---|---|---|---|---|
| 3,022,481 | A * | 2/1962 | Stepoway | 439/329 |
| 3,720,907 | A * | 3/1973 | Asick | 439/636 |
| 4,445,742 | A * | 5/1984 | Fullam | 439/597 |
| 4,558,912 | A * | 12/1985 | Coller et al. | 439/246 |
| 4,712,848 | A * | 12/1987 | Edgley | 439/327 |
| 4,838,804 | A * | 6/1989 | Banjo et al. | 439/325 |
| 5,020,999 | A * | 6/1991 | Dewitt et al. | 439/328 |
| 5,155,663 | A * | 10/1992 | Harase | 361/679.31 |
| 5,184,961 | A * | 2/1993 | Ramirez et al. | 439/59 |
| 5,309,630 | A | 5/1994 | Brunker et al. | |
| 5,812,370 | A * | 9/1998 | Moore et al. | 361/679.38 |
| 5,890,195 | A * | 3/1999 | Rao | 711/105 |
| 6,089,905 | A * | 7/2000 | Shimmyo et al. | 439/495 |
| 6,341,988 | B1 * | 1/2002 | Zhu et al. | 439/630 |
| 6,408,352 | B1 * | 6/2002 | Hosaka et al. | 710/301 |
| 6,796,806 | B2 * | 9/2004 | Boutros et al. | 439/76.1 |
| 6,854,995 | B2 | 2/2005 | Hotea | |
| 6,899,555 | B2 * | 5/2005 | Nagata et al. | 439/159 |
| 6,942,514 | B1 * | 9/2005 | Cheng et al. | 439/328 |
| 7,044,773 | B2 | 5/2006 | Suzuki et al. | |
| 7,048,567 | B2 | 5/2006 | Regnier et al. | |
| 7,198,519 | B2 | 4/2007 | Regnier et al. | |
| 7,297,020 | B2 | 11/2007 | Takahira | |
| 7,311,542 | B2 | 12/2007 | Suzuki | |
| 7,344,399 | B2 | 3/2008 | Iijima et al. | |

(Continued)

FOREIGN PATENT DOCUMENTS

WO 90/04272 * 4/1990

*Primary Examiner* — Neil Abrams
(74) *Attorney, Agent, or Firm* — McCormick, Paulding & Huber LLP

(57) ABSTRACT

A connector includes an insulator having an accommodation space into which an object to be connected to the connector is removably insertable, the object being a thin plate having a pair of engaging recesses at opposite side edges thereof; at least one contact fixed to the insulator, the object being connected to the contact upon insertion into the accommodation space; and a pair of resilient engaging protrusions, each having an engaging portion, which are resiliently deformable away from each other in a plane in which the object lies, the engaging portions being respectively engaged in the pair of engaging recesses of the inserted object. A distance between the engaging portions of the pair of resilient engaging protrusions in a free state is smaller than a width of an insertion end of the object which is to be inserted into the accommodation space.

14 Claims, 5 Drawing Sheets

U.S. PATENT DOCUMENTS 7,357,663 B2 * 4/2008 Wei et al. ..... 439/495
7,494,366 B2 2/2009 Suzuki et al.
7,563,128 B2 7/2009 Suzuki et al.
2002/0045374 A1 4/2002 Kunishi et al.
2006/0183364 A1 8/2006 Suzuki et al.
2010/0261369 A1 * 10/2010 Satoh ..... 439/328

* cited by examiner

CONNECTOR FOR PLATE-SHAPED OBJECT

CROSS REFERENCE TO RELATED APPLICATION

The present invention is related to and claims priority of the following co-pending application, namely, Japanese Patent Application No. 2009-95293 filed on Apr. 9, 2009.

FIELD OF THE INVENTION

The present invention relates to a connector to which a thin plate-shaped object such as an FPC or FFC is to be connected.

DESCRIPTION OF THE PRIOR ART

The connector disclosed in Japanese Patent Publication No. 3925919 is provided with an insulator (housing), a plurality of contacts (terminals) and a rotational actuator (movable piece). The insulator is formed to allow a thin plate-shaped connecting object (object to be connected to the connector) having a pair of engaging recesses (notches) provided on both sides thereof, respectively, to be inserted into and removed from the insulator, the plurality of contacts are fixed side by side to the insulator, and the rotational actuator is rotatably supported by the insulator. In addition, the insulator is provided integrally with a pair of (left and right) lock lugs capable of being resiliently deformed in the vertical direction, and each lock lug is provided at the free end thereof with an engaging claw which engages in the associated engaging recess of the insulator upon the connecting object being inserted into the insulator.

Inserting the connecting object into the insulator with the rotational actuator open causes the pair of lock lugs to be resiliently deformed upwardly by the insertion end of the connecting object. Upon the pair of engaging recesses being moved to positions immediately below the pair of engaging claws, respectively, the pair of lock lugs resiliently return to the initial shapes thereof to thereby bring the pair of engaging claws into engagement with the pair of engaging recesses from above, respectively.

In this state, rotating the rotational actuator in the closing direction causes the rotational actuator to press against an upper surface of the connecting object downwardly, thus causing terminal areas formed on a lower surface of the connecting object to come into contact with the plurality of contacts of the connector.

In recent years, there has been a strong demand to reduce the height (thickness) of this type of connector. However, formation of lock lugs such as described above that are resiliently deformable in the vertical direction on the insulator causes an increase in height of the insulator, thus making it difficult to achieve a further reduction in height of the connector.

Additionally, in conjunction with reduction in height of the connector, reduction in thickness of the connecting object has also progressed. Accordingly, the rigidity of such recently-produced connecting objects is extremely low, so that peripheral portions of the pair of engaging recesses are very easily deformed. If each lock lug of the insulator is short in length (length as a spring member) and thus difficult to deform by a small load imposed thereon, efforts associated with bringing the engaging claw of such a lock lug into engagement with the aforementioned low-rigid type of connecting object result in a large deformation of the peripheral portion of the associated engaging recess of the connecting object, which makes it difficult to bring the pair of engaging recesses into engagement with the engaging claws of the pair of lock lugs, thus resulting in deterioration in workability. Accordingly, in order to bring the engaging claws of the pair of lock lugs to be respectively engaged in the pair of engaging recesses of the connecting object in a easy manner, each lock lug needs to be designed so as to be easily deformed even by a small load, e.g., by forming each lock lug so as to have a long length.

In addition, if the thickness of the connecting object is reduced, the dimension of each engaging recess in the vertical direction (i.e., the thickness of each engaging recess) is reduced correspondingly. Additionally, the connecting object is usually produced by layering a plurality of thin-film members and joining these thin-film members together by an adhesive. However, it is difficult to control the engineering tolerance in the size of the elements of the connecting object such as the cumulative tolerance of each thin-film member and the variation in the thickness of each adhesive layer, so that proportion of the engineering tolerance becomes large compared to the thickness in the case of a thin connecting object (e.g., an FPC thickness and an engineering tolerance of: 0.15±0.03 mm). Namely, in the case where a large number of thin connecting objects of the same specifications are manufactured, the engaging force of the pair of lock lugs of the insulator with the connecting object becomes small on each connecting object and also varies depending on individual differences in thickness of each connecting object.

To prevent this sort of problem from occurring, the dimension of the engaging claw of each lock lug in the vertical direction needs to be increased (i.e., increased to be greater than the vertical dimensions of each engaging recess). However, if the engaging claw of each lock lug is formed in such a shape, each lock lug needs be formed to be resiliently deformable by a large amount in the vertical direction, which is contradictory with respect to the demand for reduction in height of the connector.

SUMMARY OF THE INVENTION

The present invention provides a connector allowing a thin plate-shaped object to be securely engaged with the connector with excellent workability even in the case where a reduction in height of the connector is achieved.

According to an aspect of the present invention, a connector is provided, including an insulator having an accommodation space into which an object to be connected to the connector is removably insertable, the object being shaped into a thin plate and having a pair of engaging recesses at opposite side edges of the object; at least one contact fixed to the insulator, the object being connected to the contact upon being inserted into the accommodation space; and a pair of resilient engaging protrusions, each having an engaging portion, which are resiliently deformable in opposite directions away from each other in a plane in which the object lies, the engaging portions of the pair of resilient engaging protrusions being respectively engaged in the pair of engaging recesses of the object that is inserted into the accommodation space. A distance between the engaging portions of the pair of resilient engaging protrusions in a free state is smaller than a width of an insertion end of the object which is to be inserted into the accommodation space.

In the connector according to the present invention, the object to be connected to the connector can be securely engaged with the connector because the engaging portions of the pair of resilient engaging protrusions are engaged in the pair of engaging recesses of the object, respectively, upon the object being inserted into the accommodation space of the insulator.

Moreover, since the pair of resilient engaging protrusions deform in a plane in which the object to be connected lies, the thickness (height) of the connector is not increased even though such resilient engaging protrusion are provided, enabling a reduction in height of the connector (low-profile connector). In addition, in the case where the object is extremely thin and the rigidity thereof is extremely low (thus easily deformable), the pair of resilient engaging protrusions need to be designed so as to be easily deformable. However, this kind of design does not increase the thickness of the connector either, thus making a reduction in height (thickness) of the connector possible.

Additionally, to increase the engaging force between the object and the connector in the case where the thickness of the object is small, the thickness of the engaging portion of each resilient engaging protrusion needs to be increased. However, in such a case also, the pair of resilient engaging protrusions do not need to be resiliently deformed in the upward/downward (vertical) direction, and accordingly, a reduction in height of the connector can be achieved.

Moreover, since the pair of resilient engaging protrusions are resiliently deformed in a plane in which the object to be connected lies, any variation in the thickness of the object to be connected has little influence on the insertion and variation of the engaging force thereof. Therefore, the connector can be provided with a stable quality and performance.

The insulator includes a pair of guide portions, positioned closer to an insertion opening of the accommodation space than the pair of resilient engaging protrusions, for guiding the object to a position between the pair of resilient engaging protrusions.

Accordingly, since the object to be connected is precisely guided to a predetermined position between the pair of resilient engaging protrusions via the pair of guide portions when the object being connected is inserted into the accommodation space of the insulator, the object can be engaged with the connector more securely by the pair of resilient engaging protrusions. Moreover, since the object to be connected does not shift (or slant) to either side in the leftward/rightward direction, each resilient engaging protrusion can be prevented from buckling.

Additionally, also upon the insertion of the object into the accommodation space, each resilient engaging protrusion can be prevented from being plastically deformed or damaged because each resilient engaging protrusion is not deformed more than necessary by an application of an excessive force to one of the pair of resilient engaging protrusions.

It is desirable for the pair of resilient engaging protrusions and the insulator to be molded integrally out of a same material.

Accordingly, the pair of resilient engaging protrusions can be easily manufactured at a low production cost.

It is desirable for the engaging portions of the pair of resilient engaging protrusions to be greater in thickness than the pair of engaging recesses.

Accordingly, the engaging force between each engaging recess and the engaging portion of the associated resilient engaging protrusion becomes great, so that the object can be securely engaged with the connector even if the object is extremely thin. In addition, by designing the object to be connected as a thin object, each manufactured object, to be connected to the connector, can be securely engaged with the connector even when the thicknesses of the objects vary.

It is desirable for the connector to include at least one insertion limit portion which limits a rearward movement of the object within the accommodation space, wherein base ends of the pair of resilient engaging protrusions are positioned on the opposite side of the insertion limit portion to that at which the insertion opening is positioned.

Accordingly, it is possible to increase the length of each resilient engaging protrusion while minimizing an increase in the dimensions of the connector (insulator) (specifically, in the insertion direction of the object into the connector). This improves the spring property of each resilient engaging protrusion. Namely, in an initial insertion state of the object to be connected (or upon insertion thereof), even a small load exerted by the object can move the engaging portion of each resilient engaging protrusion, and the resiliency of each resilient engaging protrusion increases as the amount of resilient deformation thereof increases, which achieves an excellent insertion ability of the object into the connector. Moreover, the engaging force is further enhanced after the object is inserted into the connector.

It is desirable for a pair of bottom holes to be formed in the insulator to receive the lower parts of the pair of engaging projections, respectively.

Accordingly, since it is possible to increase the thickness of each resilient engaging protrusion without increasing the thickness of the entire connector, each resilient engaging protrusion can maintain a sufficient spring property even if the height of the connector is reduced. Therefore, the pair of resilient engaging protrusions can provide a satisfactory tactile click upon being engaged in the pair of engaging recesses, respectively, and the pair of resilient engaging protrusions can be prevented from being damaged by a careless operation.

In addition, if the pair of bottom holes are utilized, the insulator (and also the pair of resilient engaging protrusions) can be molded by injection molding using a molding die without forming any through-holes through the top surface of the insulator. Therefore, even in a small connector, the top surface of the insulator can be sucked and held by a suction nozzle of a suction machine for a mounting machine/mounter and the insulator (connector) can be moved from one place to another by moving the suction machine.

It is desirable for the connector to include an actuator which presses one of the object inserted into the accommodation space and the contact toward the other.

Accordingly, the contact and the object can be connected to each other more securely.

It is desirable for the pair of resilient engaging protrusions to be positioned on opposite sides of the accommodation space in a direction orthogonal to an insertion direction of the object into the accommodation space.

It is desirable for a plurality of the contacts and a plurality of the insertion limit portions to be alternately arranged in a direction orthogonal to an insertion direction of the object into the accommodation space.

It is desirable for the insertion limit portion to be integral with the insulator.

It is desirable for each of the pair of bottom holes to be a through-hole.

It is desirable for the contact to include a first arm and a second arm which face each other with a predetermined distance therebetween; and a resilient connecting portion which connects the first arm and the second arm to each other. The connector further includes an actuator which moves one end of the second arm toward the insertion end of the object in the accommodation space by pressing the other end of the second arm in a direction away from an adjacent one end of the first arm with the object being inserted in between the other end of the first arm and the one end of the second arm.

It is desirable for the actuator includes a pair of pivots which project in opposite directions from laterally opposite ends of the actuator, respectively, wherein the actuator is rotatable about the pair of pivots relative to the insulator.

It is desirable for the pair of guide portions to be formed at opposite ends of the insertion opening in a direction orthogonal to an insertion direction of the object into the accommodation space, each of the pair of guide portions including an inclined surface which is inclined to a plane orthogonal to the plane in which the object lies.

In an embodiment, a connector having an insulator and a plurality of contacts is provided, each of which having two prongs for holding therebetween an object which is to be connected to the contact. The insulator includes a pair of resilient engaging protrusions, each having one engaging portion which is resiliently deformable in an opposite direction away from the other in a plane in which the object lies. The object is formed as a thin plate and has a pair of engaging recesses at opposite side edges thereof. The engaging portions of the pair of resilient engaging protrusions are respectively engaged in the pair of engaging recesses of the object upon the object being inserted into an accommodation space of the insulator. A distance between the engaging portions of the pair of resilient engaging protrusions in a free state is smaller than a width of an insertion end of the object which is to be inserted into the accommodation space.

BRIEF DESCRIPTION OF THE DRAWINGS

The present invention will be discussed below in detail with reference to the accompanying drawings, in which.

DESCRIPTION OF THE EMBODIMENT

Figure 1:
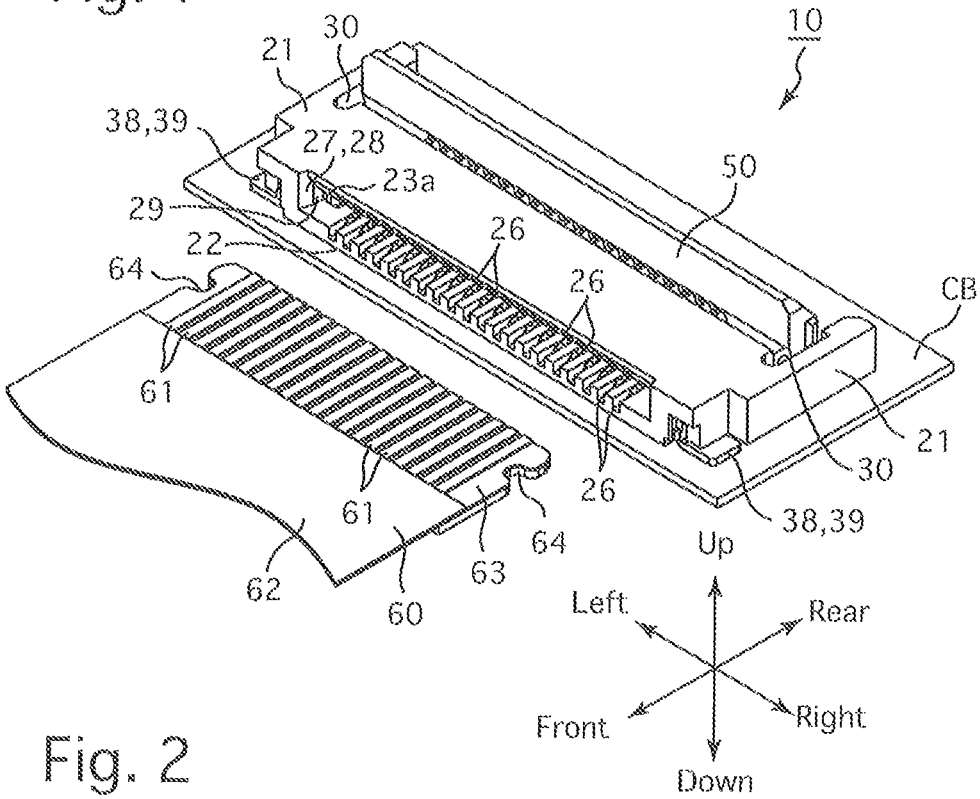
FIG. 1 is a perspective view of an embodiment of a connector according to the present invention and an FPC which is connected to the connector, showing a state where the rotational actuator of the connector is in the unlocked position.
Figure 2:
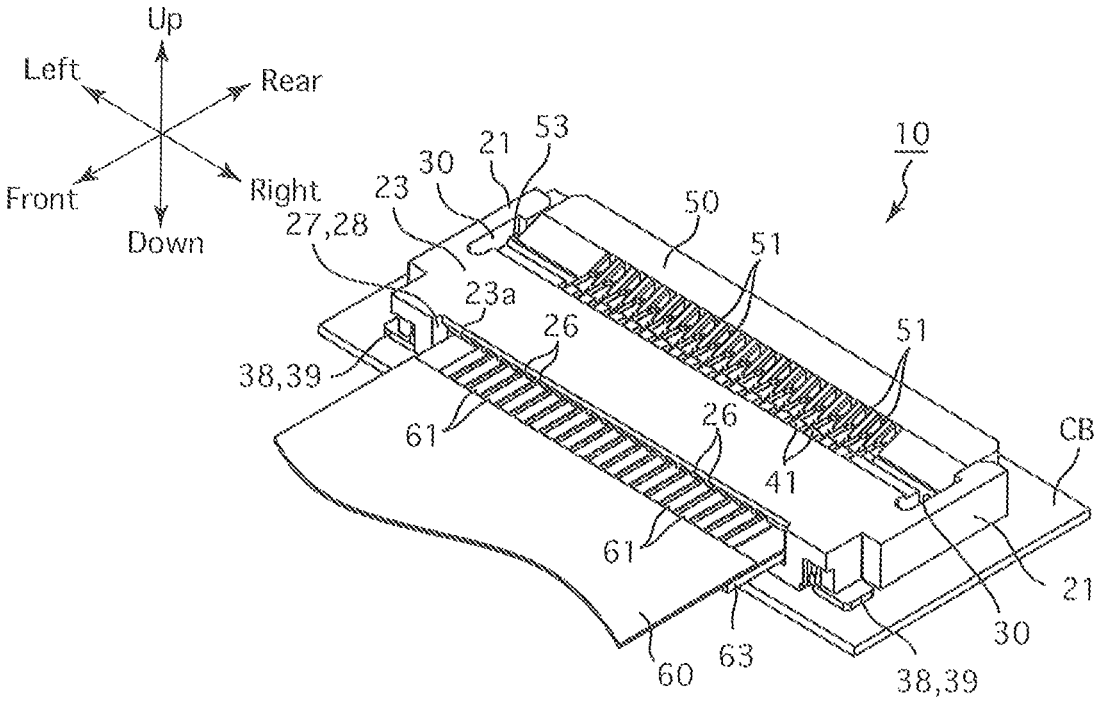
FIG. 2 is a perspective view of the connector and the FPC inserted into the connector with the rotational actuator in the locked position.

An embodiment of a connector according to the present invention will be hereinafter discussed with reference to FIGS. 1 through 12. In the following descriptions, forward and rearward directions, leftward and rightward directions, and upward and downward directions of the connector 10 are determined with reference to the directions of the double-headed arrows shown in the drawings.

The connector 10 is provided with an insulator 20, two (left and right) anchors 38, twenty contacts 40 and a rotational actuator 50, which constitute major elements of the connector 10.

The insulator 20 is formed from electrical-insulative and heat-resistant synthetic resin by injection molding. The insulator 20 is provided with a pair of (left and right) side walls 21, a bottom plate 22 and a top plate 23. The bottom ends of the pair of side walls 21 are connected to each other via the bottom plate 22, and the top ends of front halves of the pair of side walls 21 are connected to each other via the top plate 23. The space surrounded by (defined by) the pair of side walls 21, the bottom plate 22 and the top plate 23 is an accommodation space 25.

The insulator 20 is provided between the rear of the top plate 23 and the bottom plate 22 with a total of twenty-one partition walls (insertion limit portions) 24, which are integrally formed with the top plate 23 and the bottom plate 22, and arranged at regular intervals in the leftward/rightward direction. Each partition wall 24 extends substantially in the vertical direction of the insulator 20 and is provided between adjacent partition walls 24 with a total of twenty contact support grooves 26, each of which is elongated in the forward/rearward direction from the position of the front ends of the bottom plate 22 and the top plate 23 to the rear ends of the bottom plate 22 and the top plate 23. The insulator 20 is provided at the front ends of the pair of side walls 21 with left and right guide portions 27, respectively. The upper and lower ends of each guide portion 27 is connected to the top plate 23 and the bottom plate 22, respectively. The inwardly-facing surfaces of the left and right guide portions 27, which face each other in the leftward/rightward direction, are each provided on a front half and a rear half thereof with an inclined guide surface 28 and a vertical parallel surface 29 (see FIGS. 7 and 12). The vertical parallel surfaces 29 of the left and right guide portions 27 are parallel to each other. The left and right inclined guide surfaces 28 are inclined in directions to guide an FPC 60 into the accommodation space 25. In addition, the top plate 23 is provided on a front end thereof with an inclined surface 23*a* which is inclined in a direction so as to guide the FPC 60 into the accommodation space 25. The left and right side walls 21 are provided, toward the rear thereof on inner side surfaces of the left and right side walls 21, with two (left and right) bearing recesses 30, respectively. The left and right side walls 21 are provided on the front surfaces thereof with two (left and right) anchor-receiving recesses 31, respectively, which are recessed in a rearward direction. Each anchor 38 is provided with a tail portion 39 which lies substantially horizontal. The rear ends of the left and right anchors 38 are fitted into the left and right anchor-receiving recesses 31 from the front thereof, respectively.

Figure 3:
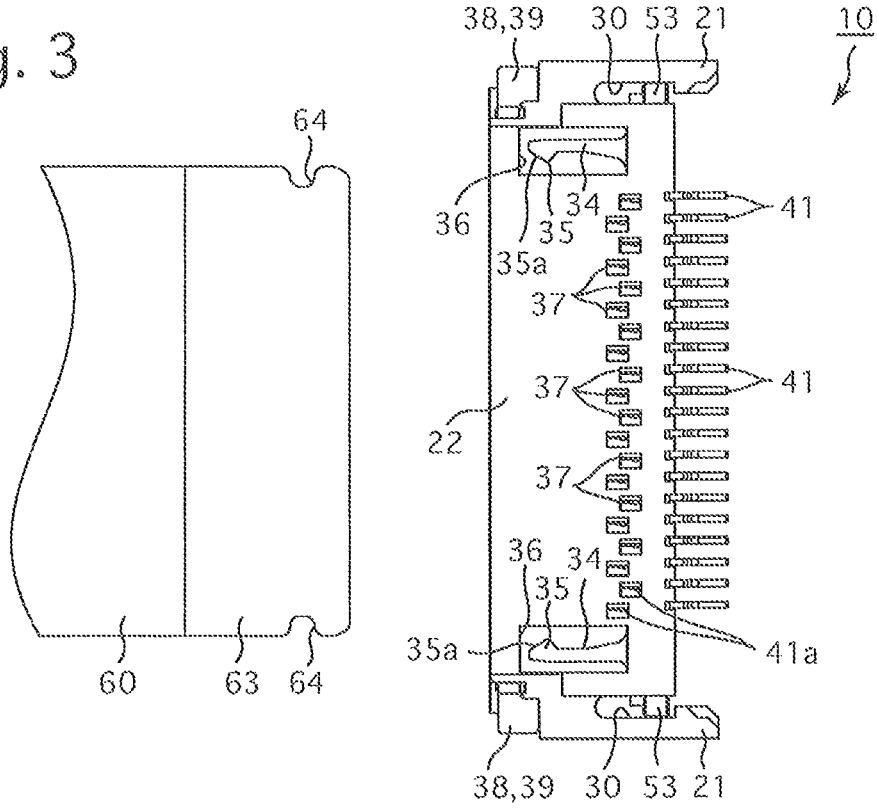
FIG. 3 is a bottom view of the connector and the FPC in the same state as those in FIG. 1.
Figure 4:
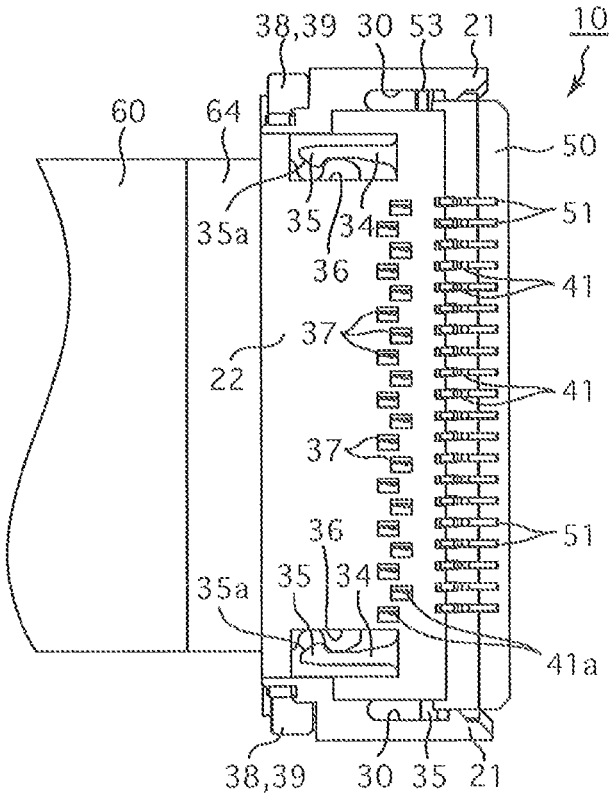
FIG. 4 is a bottom view of the connector and the FPC in the same state as those in FIG. 2.
Figure 7:
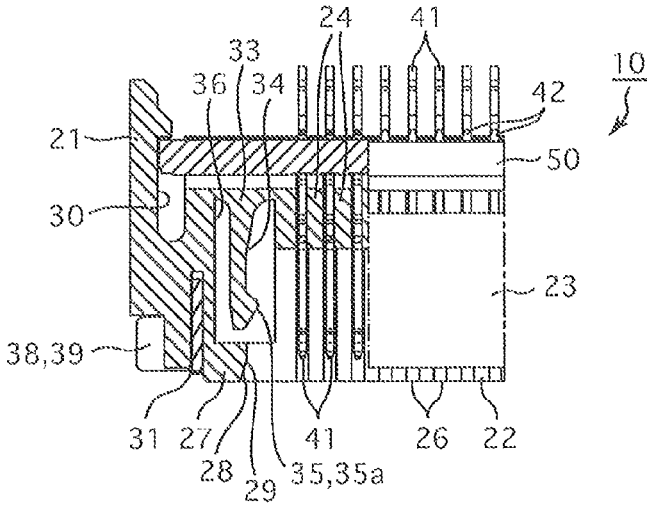
FIG. 7 is a cross sectional view taken along the line VII-VII shown in FIG. 6, viewed in the direction of the appended arrows.
Figure 8:
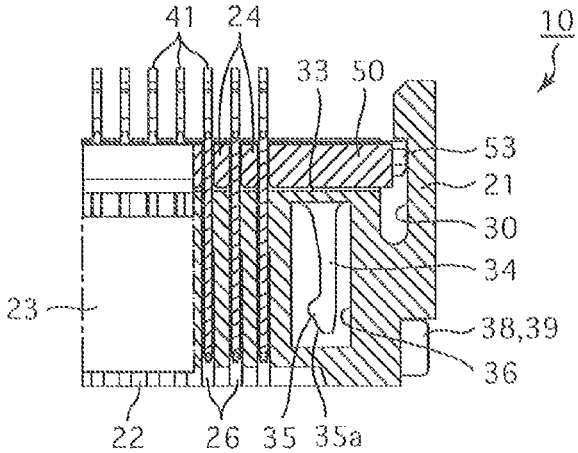
FIG. 8 is a cross sectional view taken along the line VIII-VIII shown in FIG. 6, viewed in the direction of the appended arrows.
Figure 9:
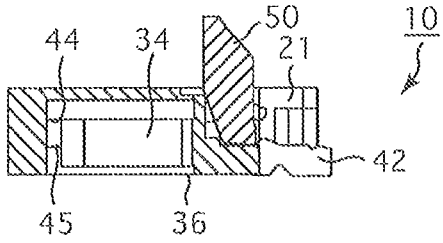
FIG. 9 is a cross sectional view taken along the line IX-IX shown in FIG. 6, viewed in the direction of the appended arrows.
Figure 12:
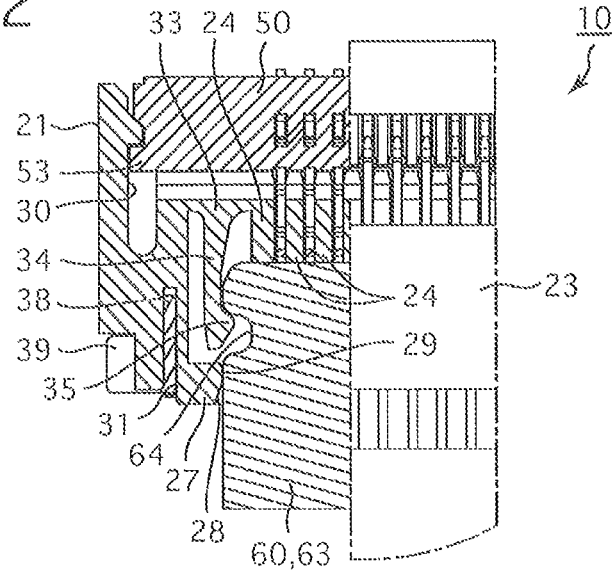
FIG. 12 is a view similar to that of FIG. 7, showing a state where the FPC is inserted into the connector with the rotational actuator rotated to the locked position thereafter.

As shown in FIGS. 7, 8 and 12, the insulator 20 is provided, between the left side wall 21 and the rear end of the leftmost partition wall 24 adjacent to the left side wall 21, with a left support 33 via which the left side wall 21 and the rear end of the leftmost partition wall 24 are connected to each other, and is provided, between the right side wall 21 and the rear end of the rightmost partition wall 24 adjacent to the right side wall 21, with a right support 33 via which the right side wall 21 and the rear end of the rightmost partition wall 24 are connected to each other. Each of the left and right supports 33 is provided with a resilient engaging protrusion 34 which protrudes forwardly. Each resilient protrusion 34 is provided integrally at a front end (free end) thereof with an engaging claw (engaging portion) 35 which projects inwardly. As shown in FIGS. 3 and 4, the bottom plate 22 of the insulator 20 is provided, at portions thereof which correspond to the left and right resilient engaging protrusions 34, with a pair of (left and right) bottom holes 36 formed as through-holes, respectively, and the lower parts of the left and right engaging projections 34 are positioned in the left and right bottom holes 36, respectively. As shown in the drawings, there is a clearance between each resilient engaging protrusion 34 and the inner periphery of the associated bottom hole 36, so that the left and right resilient engaging protrusions 34 are resiliently deformable in opposite directions away from each other from the initial free-state positions (positions shown in FIGS. 3, 7 and 8).

As shown in FIG. 7, the inward ends of the engaging claws 35 of the left and right resilient engaging protrusions 34 in a free state are positioned closer to the center of the insulator 20 than the left and right guide portions 27 (the left and right inclined guide surfaces 28 and the left and right vertical parallel surfaces 29) in the leftward/rightward direction, respectively. Furthermore, in a free state of the left and right resilient engaging protrusions 34, the frontmost end of a front inclined surface 35*a* of the left engaging claw 35 is positioned closer to the left side of the insulator 20 than a plane in which the left vertical parallel surface 29 lies (in the forward/rearward direction), while the frontmost end of a front inclined surface 35*a* of the right engaging claw 35 is positioned closer to the right side of the insulator 20 than a plane in which the right vertical parallel surface 29 lies (in the forward/rearward direction). Additionally, the base ends (rear ends) of the left and right resilient engaging protrusions 34 are positioned behind the front surface (insertion limit portion) of each partition wall 24 in the forward/rearward direction.

The bottom plate 22 is provided between the left and right bottom holes 36 with a total of twenty die-cut holes 37 formed as through-holes which are smaller in dimensions than the left and right bottom holes 36. Each die-cut hole 37 extends to the bottom end of the corresponding partition wall 24 so as to make the lower end of the right side surface of this partition wall 24 recessed leftward. The left and right bottom holes 36 and each die-cut hole 37 can be utilized as holes for pulling a molding die (not shown) for the insulator 20 from the insulator 20 after the insulator is molded by injection molding.

The total of twenty contacts 40 are each formed from a thin base material made of a resilient copper alloy (e.g., phosphor bronze, beryllium copper or titanium copper) or a resilient Corson-copper alloy and formed into the shape shown in the drawings by stamping, and is coated with firstly nickel (Ni) plating as base plating and subsequently gold (Au) plating as finish plating.

Figure 5:
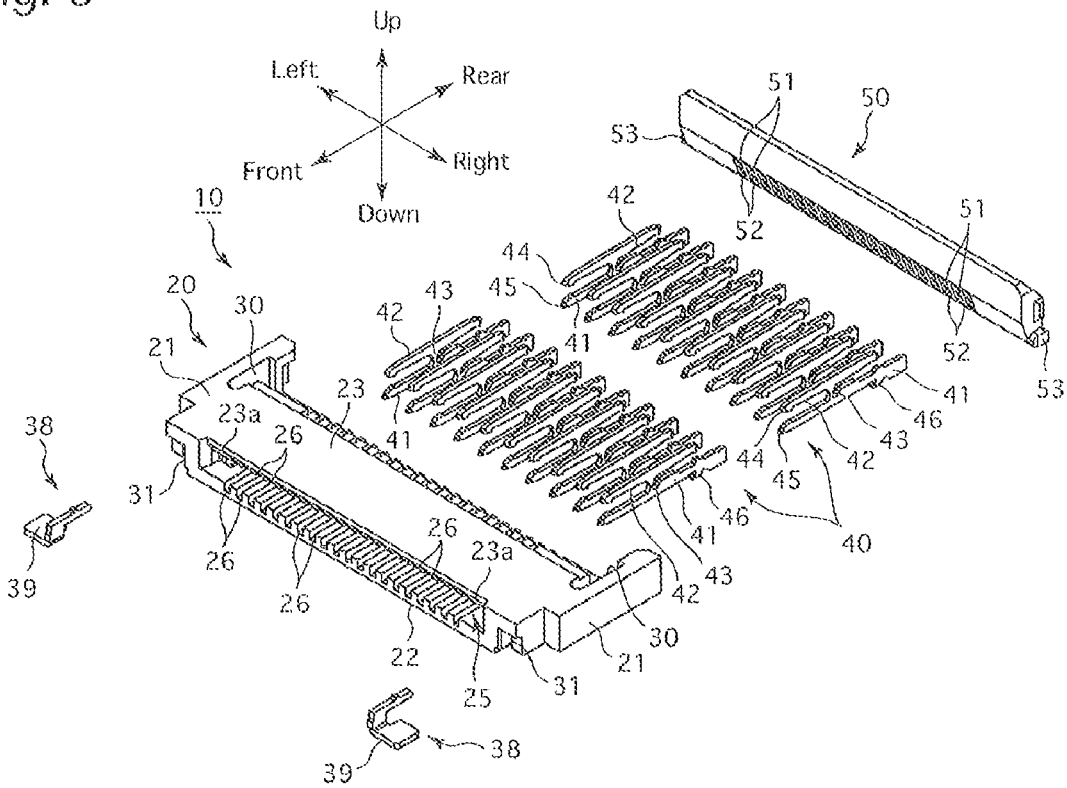
FIG. 5 is an exploded perspective view of the connector.
Figure 6:
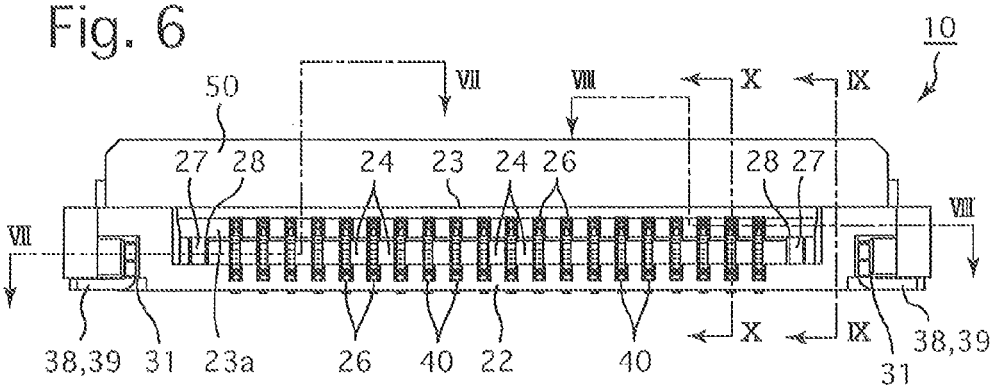
FIG. 6 is a front elevational view of the connector with the rotational actuator in the unlocked position.
Figure 10:
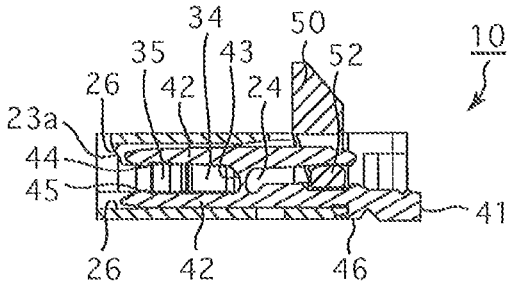
FIG. 10 is a cross sectional view taken along the line X-X shown in FIG. 6, viewed in the direction of the appended arrows.
Figure 11:
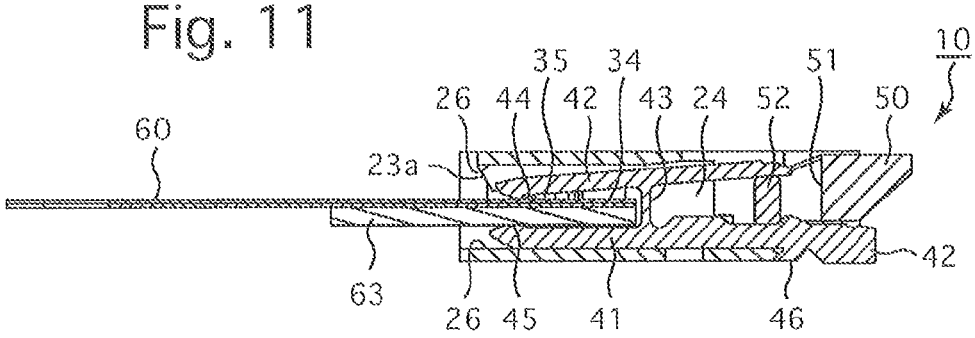
FIG. 11 is a view similar to that of FIG. 10, showing a state where the FPC is inserted into the connector with the rotational actuator rotated to the locked position thereafter.

As shown in FIGS. 5, 10 and 11, each contact 40 is in the shape of a substantially letter H in side view and is provided with a first arm (lower arm) 41, a second arm (upper arm) 42 and a resilient connecting portion 43. The first arm 41 and the second arm 42 are substantially parallel to each, and the resilient connecting portion 43 connects middle portions of the first arm 41 and the second arm 42 to each other. The first arm 41 and the second arm 42 are provided at the front ends thereof with a contacting projection 44 and a contacting projection 45, respectively, which project toward each other to face each other. The first arm 41 is provided, on the bottom surface thereof in the vicinity of the rear end of the first arm 41, with a hook-shaped engaging portion 46. In addition, the first arm 41 of each contact 40 is provided on a left side surface thereof with an engaging projection 41*a* (see FIGS. 3 and 4). The engaging projections 41*a* of the ten contacts 40 at odd numbered positions from the right side are positioned behind the engaging projections 41*a* of the remaining ten contacts 40 at even numbered positions from the right side in the forward/rearward direction.

The twenty contacts 40 are inserted into the twenty contact support grooves 26 from the rear side, respectively. As shown in FIGS. 10 and 11, upon each contact 40 being inserted into the associated contact support groove 26, a lower surface of each contact 40 comes in contact with the bottom surface of the associated contact support groove 26 (the bottom of an associated groove formed on the bottom plate portion 22), a space is defined between the upper surface of the second arm 42 of each contact 40 and the ceiling of the associated contact support groove 26 (the ceiling of an associated groove formed on the top plate 23), and the hook-shaped engaging portion 46 of the first arm 41 of each contact 40 is engaged with the rear end of the bottom plate portion 22. In addition, as shown in FIGS. 3 and 4, each contact 40 is prevented from moving rearward by the engagement of the engaging projection 41*a* thereof with the associated die-cut hole 37.

The rotational actuator 50 is a plate member elongated in the leftward/rightward direction and molded out of a heat-resistant synthetic resin by injection molding. The rotational actuator 50 is provided with a total of twenty through-holes 51 which are arranged at regular intervals in the leftward/rightward direction. The rotational actuator 50 is provided immediately below (with respect to FIG. 5) the twenty through-holes 51 with twenty cam portions 52, respectively, each of which is approximately rectangular in cross sectional shape. Additionally, the rotational actuator 50 is provided, at lower ends of the left and right side surfaces thereof with respect to FIG. 5, with a pair of (left and right) pivots 53, respectively, which project in opposite directions away from each other in the leftward/rightward direction to be substantially coaxial with the twenty cam portions 52.

The rotational actuator 50 that has the above described structure is pivoted on the insulator 20 to be rotatable about the left and right pivots 53 with the left and right pivots 53 being engaged into the left and right bearing recesses 30 that are formed in the left and right side wall portions 21 of the insulator 20, respectively (see FIGS. 3 and 4), and with the rear ends of the second arms 42 of the twenty contacts 40 being inserted into the twenty through-holes 51, respectively. The rotational actuator 50 is rotatable between an unlocked position shown in FIGS. 1, 6, 9 and 10, in which the rotational actuator 50 stands substantially vertical, and a locked position shown in FIGS. 2, 4, 11 and 12, in which the rotational actuator 50 lies substantially horizontal.

In order to mount the connector 10 that has the above described structure onto a top surface of a circuit board CB (see FIGS. 1 and 2), firstly, by sucking and holding the top surface (the surface in which none of the twenty die-cut holes 37 are formed) of the top plate portion 23 of the insulator 20 by a suction machine (not shown) positioned above the connector 10, and subsequently by moving this suction machine, the rear ends (tail portions) of the first arms 41 of the twenty contacts 40 are mounted onto a circuit pattern (not shown) formed on the top surface of the circuit board CB to which a predetermined amount of solder paste has been applied, and the tail portions 39 of the left and right anchors 38 are mounted onto a ground pattern (not shown) on the circuit board CB to which solder paste has been applied. Subsequently, each application of solder paste is melted by heat in a reflow furnace. Thereupon, the rear ends of the first arms 41 of twenty contacts 40 are soldered to the circuit pattern while the left and right tail portions 39 are soldered to the ground pattern, which completes the mounting of the connector 10 to the circuit board CB.

The FPC (Flexible Printed Circuit) 60, which constitutes an object to be connected to the connector 10, is a long member in the shape of a flat plate, and the thickness of the FPC 60 is smaller than the amount of clearance between the contacting projection 44 and the contacting projection 45 of each contact 40 in a free state thereof. The thickness of the FPC 60 is extremely small, e.g., approximately 0.2 mm to 0.15 mm, so that the FPC 60 has an extremely small rigidity and therefore can be deformed easily. The FPC 60 has a multi-layered structure made up of a plurality of thin films which are bonded together and is provided with a circuit pattern having a total of twenty traces 61, an insulating cover layer 62 and an end reinforcing member 63. Each trace 61 extends linearly in the longitudinal direction of the FPC 60. The insulating cover layer 62 covers both sides of the FPC 60 except both ends of each trace 61. Upper surfaces (with respect to FIGS. 1 and 2) of the end reinforcing member 63, which is a main part of both ends of FPC 60, in the lengthwise direction thereof are made integral with both ends of each trace 61. The end reinforcing member 63 is greater in rigidity than the remaining part of the FPC 60. In addition, the end reinforcing member 63 is provided at opposite side edges thereof with a pair of (left and right) engaging recesses 64, respectively.

As shown in FIGS. 2, 4, 11 and 12, upon the end of the FPC 60 being inserted into the accommodation space 25 from the front of the insulator 20 with the rotational actuator 50 of the connector 10 (that is integral with the circuit board CB) being positioned in the unlocked position, the end reinforcing member 63 is linearly moved rearward in the accommodation space 25 while being guided by the left and right inclined guide surfaces 28 and the vertical parallel surfaces 29 since the width of the end reinforcing member 63 of the FPC 60 is substantially the same as (more specifically, slightly smaller than) the distance between laterally opposed surfaces of the left and right guide portions 27 of the insulator 20. Thereafter, the FPC 60 continues to move rearward until the rear end surface thereof (the right end surface with respect to FIG. 3) comes into contact with the front surfaces (insertion limit portions) of the twenty-one partition walls 24, thereby entering in between the contacting projection 44 and the contacting projection 45 of each contact 40. Since the distance between the laterally opposed surfaces of the engaging claws 35 of the left and right resilient engaging protrusions 34 is slightly smaller than the width of the end reinforcing member 63, the rear end surface of the end reinforcing member 63 comes in contact with the front inclined surfaces 35*a* of the left and right engaging claws 35 while the left and right resilient engaging protrusions 34 are resiliently deformed in opposite directions away from each other when the rear end of the end reinforcing member 63 reaches the same position as the left and right engaging claws 35 in the forward/rearward direction. Subsequently, upon the pair of engaging recesses of the end reinforcing member 63 reaching positions corresponding to the positions of the left and right engaging claws 35 in the forward/rearward direction, respectively, the left and right resilient engaging protrusions 34 resiliently return to the free state (initial positions) thereof, which brings the engaging claws 35 of the left and right resilient engaging protrusions 34 into engagement with the left and right engaging recesses 64, respectively. Upon comparing FIGS. 9, 10 and 11, it can be understood that each resilient engaging protrusion 34 (and the engaging claw 35 thereof) is greater in size in the upward/downward direction (i.e., thickness) than each engaging recess 64, and accordingly, the upper and lower ends of each engaging claw 35 project upward and downward from the FPC 60.

Rotating the rotational actuator 50 to the locked position (shown in FIGS. 2, 4, 11 and 12) with the FPC 60 being held temporarily in the accommodation space 25 via the engagement of the left and right resilient engaging protrusions 34 (the engaging claws 35 thereof) with the left and right engaging recesses 64 causes each cam portion 52 of the rotational actuator 50 to press the rear bottom of the second arm 42 of the associated contact 40 upwardly, thus causing the resilient connecting portion 43 to be resiliently deformed so that the second arm 42 rotates counterclockwise about the resilient connecting portion 43 as viewed from the right side. This causes the contacting projection 44 of each contact 40 to come into contact with the associated trace 61 of the circuit pattern on the upper surface of the FPC 60 and causes the contacting projection 45 of each contact 40 to come into contact with the bottom of the end reinforcing member 63, thus making each contact 40 into conduction with the FPC 60.

As described above, according to the present embodiment of the connector 10, the FPC 60 (the pair of engaging recesses 64) is engaged with the connector 10 via the pair of resilient engaging protrusions 34 (the engaging claws 35 thereof), which are integrally formed with the insulator 20, upon being inserted into the accommodation space 25; however, since the pair of resilient engaging protrusions 34 are resiliently deformable in a plane in which the FPC 60 lies and are undeformable in the upward/downward (vertical) direction, formation of the pair of resilient engaging protrusions 34 does not cause an increase in the dimension of the insulator 20 (and the connector 10) in the upward/downward direction. Therefore, even if a reduction in height (thickness) of the connector 10 is achieved, the FPC 60 can be securely engaged with the connector 10 before the rotational actuator 50 is rotated to the locked position.

In addition, since the FPC 60 is thin and very easily bendable, each resilient engaging protrusion 34 is made long, and the left and right engaging claws 35 are made thicker than the left and right engaging recesses 64 of the FPC 60. Due to this structure, when the FPC 60 is inserted into the accommodation space 25, each engaging claw 35 can move easily; moreover, the engagement of each engaging claw 35 with the FPC 60 is ensured, so that the FPC 60 does not easily come out of the connector 10. On the other hand, since each resilient engaging protrusion 34 is not resiliently deformable in the upward/downward direction, a reduction in height of the connector 10 can be achieved even if the pair of resilient engaging protrusions 34 (and the engaging claws 35 thereof) are formed in the above described manner.

Moreover, since positioning the lower parts of the left and right resilient engaging protrusions 34 in the left and right bottom holes 36, respectively, makes it possible to increase the thickness of each resilient engaging protrusion 34 without increasing the thickness of the entirety of the connector 10, the left and right resilient engaging protrusions 34 can secure a sufficient spring property (resiliency) even when the height of the connector 10 is reduced. Therefore, the left and right resilient engaging protrusions 34 can provide a satisfactory tactile click upon the engaging claws 35 being engaged in the left and right engaging recesses 64, respectively, and the left and right resilient engaging protrusions 34 are not damaged even if an excessive force is applied thereto by a careless operation.

In addition, since the FPC 60 is precisely guided to a predetermined position between the left and right resilient engaging protrusions 34 by the left and right guide portions 27, the engaging claws 35 of the left and right resilient engaging protrusions 34 can be securely brought into engagement with the left and right engaging recesses 64, respectively.

Furthermore, since the insertion direction of the FPC 60 is limited in the above described manner, the FPC 60 does not shift (or slant) to either side in the leftward/rightward direction. Therefore, each resilient engaging protrusion 34 is prevented from being excessively deformed or buckling by an accidental application of an excessive force to one of the left and right resilient engaging protrusions 34 by the rear end of the FPC 60.

Furthermore, upon insertion of the FPC 60 into the accommodation space 25, no excessive force is applied to either of the left and right resilient engaging protrusions 34, and accordingly, each resilient engaging protrusion 34 is prevented from being plastically deformed or damaged by being excessively deformed.

Additionally, although the left and right resilient engaging protrusions 34 are elongated in the forward/leftward direction to improve the spring property thereof, the left and right resilient engaging protrusions 34 do not increase the length of the connector 10 (the insulator 20) in the forward/rearward direction because the rear ends (base ends) of the left and right resilient engaging protrusions 34 are positioned behind the front surface of each partition wall 24 in the forward/rearward direction.

Although the present invention has been described based on the above illustrated embodiment of the connector 10, the present invention is not limited solely to this particular embodiment; making various modifications to the above illustrated embodiment of the connector is possible.

For instance, in the connector 10, the rotational actuator 50 can be replaced by a sliding actuator. In addition, the connector 10 can be modified such that the actuator is omitted from the connector 10 and that the distance between the contacting projections 44 and 45 of each contact 40 in a free state is predetermined to be slightly smaller than the thickness of the FPC 60 so that an end of the FPC 60 can be held by the contacting projections 44 and 45 of each contact 40 therebetween when the FPC 60 is inserted into the insulator 20.

Additionally, the connector 10 can be a so-called straight-type connector in which the accommodation space 25 is elongated in a direction orthogonal to the circuit board CB.

Additionally, it is possible for each resilient engaging protrusion 34 to be made separately from the insulator 20 (e.g., made as a metal spring member) and supported by the insulator 20 (in this case, a resilient member can be installed between each resilient engaging protrusion and the insulator). Furthermore, a middle portion of each resilient engaging protrusion 34 in the lengthwise direction, not the rear end thereof, can be connected to the insulator 20 so that each middle portion constitutes a base end. In this case also, it is desirable that the middle portions (the portions which are connected with the insulator 20) of the pair of resilient engaging protrusions 34 be positioned behind the front surfaces of the twenty-one partition walls 24 in the forward/rearward direction.

Additionally, an object to be connected to each contact of the connector can alternatively be a cable other than an FPC, e.g., a flexible flat cable (FFC).

Obvious changes may be made in the specific embodiment of the present invention described herein, such modifications being within the spirit and scope of the invention claimed. It is indicated that all matter contained herein is illustrative and does not limit the scope of the present invention.

What is claimed is:

1. A connector comprising:

an insulator having an accommodation space into which an object to be connected to said connector is removably insertable, said object being shaped into a thin plate and having a pair of engaging recesses at opposite side edges of said object;

at least one contact fixed to said insulator, said object being connected to said contact upon being inserted into said accommodation space; and a pair of resilient engaging protrusions, each having an engaging portion, which are resiliently deformable in opposite directions away from each other in a plane in which said object lies, said engaging portions of said pair of resilient engaging protrusions being respectively engaged in said pair of engaging recesses of said object that is inserted into said accommodation space, wherein a distance between said engaging portions of said pair of resilient engaging protrusions in a free state is smaller than a width of an insertion end of said object which is to be inserted into said accommodation space; and wherein a pair of bottom holes are formed in said insulator to receive the lower parts of said pair of resilient engaging protrusions, respectively.

2. The connector according to claim 1, wherein said insulator comprises a pair of guide portions, positioned closer to an insertion opening of said accommodation space than said pair of resilient engaging protrusions, for guiding said object to a position between said pair of resilient engaging protrusions.

3. The connector according to claim 1, wherein said pair of resilient engaging protrusions and said insulator are molded integrally out of a same material.

4. The connector according to claim 1, wherein said engaging portions of said pair of resilient engaging protrusions are greater in thickness than said pair of engaging recesses.

5. The connector according to claim 2, further comprising at least one insertion limit portion which limits a rearward movement of said object within said accommodation space, wherein base ends of said pair of resilient engaging protrusions are positioned on the opposite side of said insertion limit portion to that at which said insertion opening is positioned.

6. The connector according to claim 1, further comprising an actuator which presses one of said object inserted into said accommodation space and said contact toward the other.

7. The connector according to claim 1, wherein said pair of resilient engaging protrusions are positioned on opposite sides of said accommodation space in a direction orthogonal to an insertion direction of said object into said accommodation space.

8. The connector according to claim 5, wherein a plurality of said contacts and a plurality of said insertion limit portions are alternately arranged in a direction orthogonal to an insertion direction of said object into said accommodation space.

9. The connector according to claim 5, wherein said insertion limit portion is integral with said insulator.

10. The connector according to claim 1, wherein each of said pair of bottom holes is a through-hole.

11. The connector according to claim 1, wherein said contact comprises:

a first arm and a second arm which face each other with a predetermined distance therebetween; and a resilient connecting portion which connects said first arm and said second arm to each other, wherein said connector further comprises an actuator which moves one end of said second arm toward said insertion end of said object in said accommodation space by pressing the other end of said second arm in a direction away from an adjacent one end of said first arm with said object being inserted in between the other end of said first arm and said one end of said second arm.

12. The connector according to claim 6, wherein said actuator comprises a pair of pivots which project in opposite directions from laterally opposite ends of said actuator, respectively, wherein said actuator is rotatable about said pair of pivots relative to said insulator.

13. The connector according to claim 2, wherein said pair of said guide portions are formed at opposite ends of said insertion opening in a direction orthogonal to an insertion direction of said object into said accommodation space, each of said pair of guide portions including an inclined surface which is inclined to a plane orthogonal to said plane in which said object lies.

14. A connector provided with an insulator and a plurality of contacts, each of which having two prongs for holding therebetween an object which is to be connected to said contact, wherein said insulator comprises a pair of resilient engaging protrusions, each having one engaging portion which is resiliently deformable in an opposite direction away from the other in a plane in which said object lies, wherein said object is formed as a thin plate and has a pair of engaging recesses at opposite side edges thereof, wherein said engaging portions of said pair of resilient engaging protrusions are respectively engaged in said pair of engaging recesses of said object upon said object being inserted into an accommodation space of said insulator, wherein a distance between said engaging portions of said pair of resilient engaging protrusions in a free state is smaller than a width of an insertion end of said object which is to be inserted into said accommodation space; and wherein a pair of bottom holes are formed in said insulator to receive the lower parts of said pair of resilient engaging protrusions, respectively.

* * * * *